US007744430B1

(12) United States Patent
Vrenna et al.

(10) Patent No.: US 7,744,430 B1
(45) Date of Patent: Jun. 29, 2010

(54) ELECTRICAL CONNECTOR FOR ELECTRONIC MODULES

(75) Inventors: Jason Edward Vrenna, Harrisburg, PA (US); Justin Shane McClellan, Camp Hill, PA (US); Daniel Robert Ringler, Elizabethville, PA (US); Jason M'Cheyne Reisinger, Carlisle, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/351,382

(22) Filed: Jan. 9, 2009

(51) Int. Cl.
*H01R 13/40* (2006.01)

(52) U.S. Cl. ..... 439/733.1

(58) Field of Classification Search ..... 439/637, 439/733.1, 943, 885
See application file for complete search history.

(56) References Cited

U.S. PATENT DOCUMENTS 5,462,456 A 10/1995 Howell
6,139,377 A * 10/2000 Chen ..... 439/885
7,101,228 B2 9/2006 Hamner et al.

* cited by examiner

*Primary Examiner*—Phuong K Dinh

(57) ABSTRACT

An electrical contact includes a body extending along a longitudinal axis. The body includes a mating contact portion for electrical connection with an electronic module, an intermediate portion extending from the mating contact portion, and a mounting contact portion extending from the intermediate portion for electrical connection with a circuit board. The mounting contact portion extends from the intermediate portion at a bend. The mounting contact portion extends from the bend to an end portion. The body also includes a push surface formed when a carrier strip that initially connects the electrical contact to other electrical contacts is separated from the electrical contact. The push surface is offset from the bend along the longitudinal axis in a direction away from the mating contact portion.

17 Claims, 9 Drawing Sheets

ELECTRICAL CONNECTOR FOR ELECTRONIC MODULES

BACKGROUND OF THE INVENTION

The subject matter described and/or illustrated herein relates generally to electrical connectors, and, more particularly, to electrical connectors for electronic modules.

Computers and servers may use numerous types of electronic modules, such as processor and memory modules (e.g. Dynamic Random Access Memory (DRAM), Synchronous Dynamic Random Access Memory (SDRAM), or Extended Data Out Random Access Memory (EDO RAM), and the like). The memory modules are produced in a number of formats such as, for example, Single In-line Memory Modules (SIMM's), or the newer Dual In-line Memory Modules (DIMM's), Small Outline DIMM's (SODIMM's), and Fully Buffered DIMM's. Typically, the electronic modules are installed in one or more multi-pin sockets mounted on a system board or motherboard. Each electronic module has a card edge that provides an interface generally between two opposite rows of contacts in the socket.

There is an ongoing trend toward smaller electronic packages. This trend is accelerated by the adoption of certain standards such as the Advanced Telecommunications Computing Architecture (ATCA) standard. In systems that adhere to the ATCA standard, the space provided for electronic modules and socket connectors is limited. Space limitations require that the size of the electronic modules as well as the socket connectors be reduced. At least some known socket connectors include electrical contacts having a vertical contact design. However, such vertical electrical contacts may not provide a socket connector with as low of a vertical profile as desired.

There is a need for a lower profile socket connector that may be used in space-limited applications.

BRIEF DESCRIPTION OF THE INVENTION

In one embodiment, an electrical contact includes a body extending along a longitudinal axis. The body includes a mating contact portion for electrical connection with an electronic module, an intermediate portion extending from the mating contact portion, and a mounting contact portion extending from the intermediate portion for electrical connection with a circuit board. The mounting contact portion extends from the intermediate portion at a bend. The mounting contact portion extends from the bend to an end portion. The body also includes a push surface formed when a carrier strip that initially connects the electrical contact to other electrical contacts is separated from the electrical contact. The push surface is offset from the bend along the longitudinal axis in a direction away from the mating contact portion.

Optionally, the push surface is located at least as close along the longitudinal axis to the end portion of the mounting contact portion as the bend. Optionally, the body further includes an arm extending from the intermediate portion, wherein the arm has an end portion that includes the push surface. The bend may include a radially inner surface and a radially outer surface, with the push surface is optionally offset from the radially outer surface of the bend along the longitudinal axis in a direction away from the mating contact portion. Optionally, the body further includes a pair of arms extending from the intermediate portion, wherein the push surface includes a pair of push surfaces, and each arm has an end portion that includes a corresponding one of the push surfaces. The bend optionally extends between the pair of arms.

The bend may be a first bend with the mounting contact portion further including a second bend. Optionally, the push surface is offset from the second bend along the longitudinal axis in a direction away from the mating contact portion. Optionally, the intermediate portion includes an extension configured to engage a housing for retaining the electrical contact within the housing, wherein the push surface is defined by a portion of the extension. The extension optionally includes an arm, wherein the arm optionally has an end portion that includes the push surface.

In another embodiment, a socket connector assembly is provided for connecting an electronic module to a circuit board. The socket connector assembly includes a housing having a slot configured to receive a mating edge of the electronic module. A plurality of electrical contacts are held by the housing. Each electrical contact includes a body extending along a longitudinal axis. The body includes a mating contact portion for electrical connection with the electronic module, an intermediate portion extending from the mating contact portion, and a mounting contact portion extending from the intermediate portion for electrical connection with the circuit board. The mounting contact portion extends from the intermediate portion at a bend. The mounting contact portion extends from the bend to an end portion. The body also includes a push surface formed when a carrier strip that initially connects the electrical contact to other electrical contacts is separated from the electrical contact. The push surface is offset from the bend along the longitudinal axis in a direction away from the mating contact portion.

DETAILED DESCRIPTION OF THE INVENTION

Figure 1:
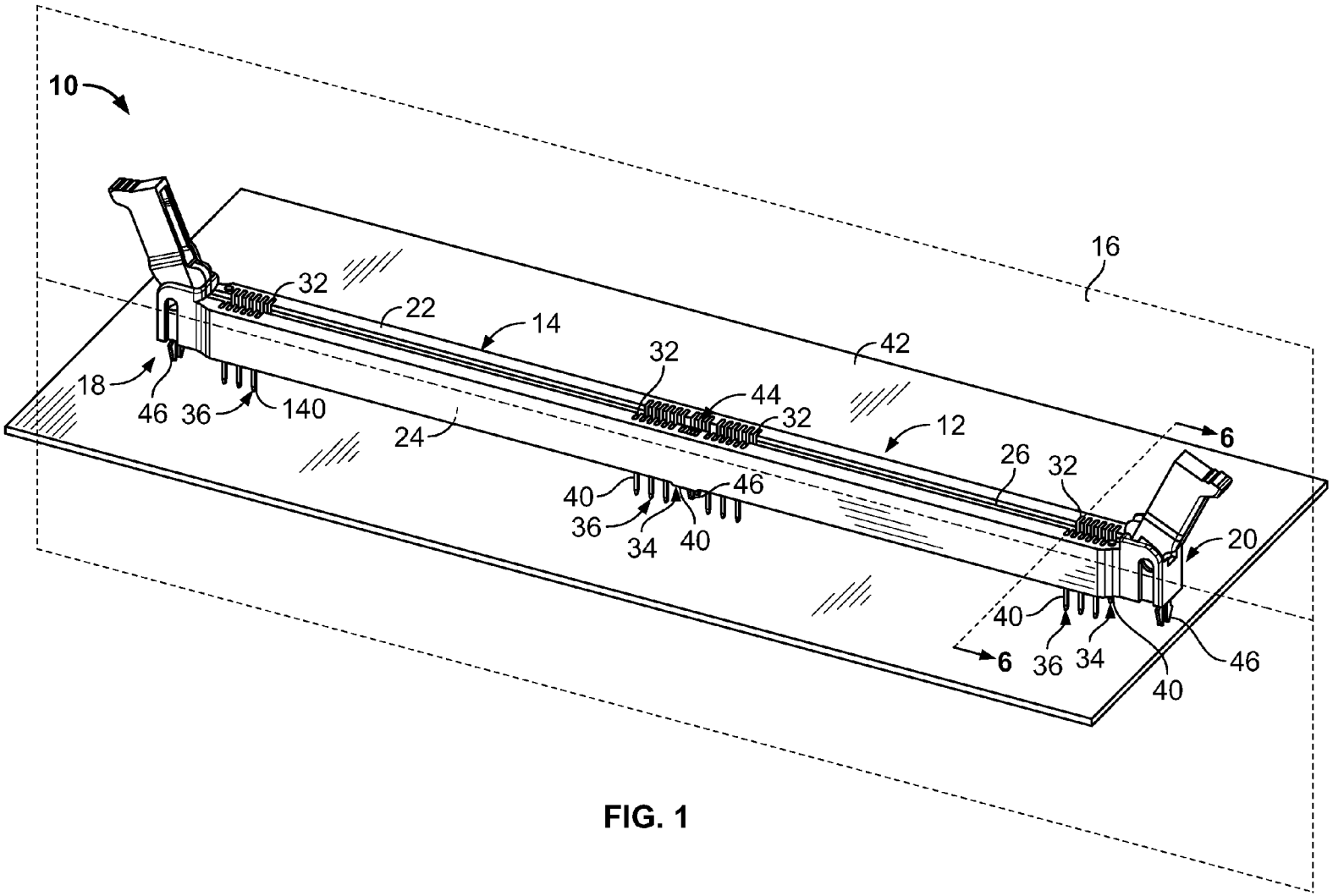
FIG. 1 is a partially exploded perspective view of an exemplary embodiment of a socket connector assembly and an exemplary circuit board.
Figure 2:
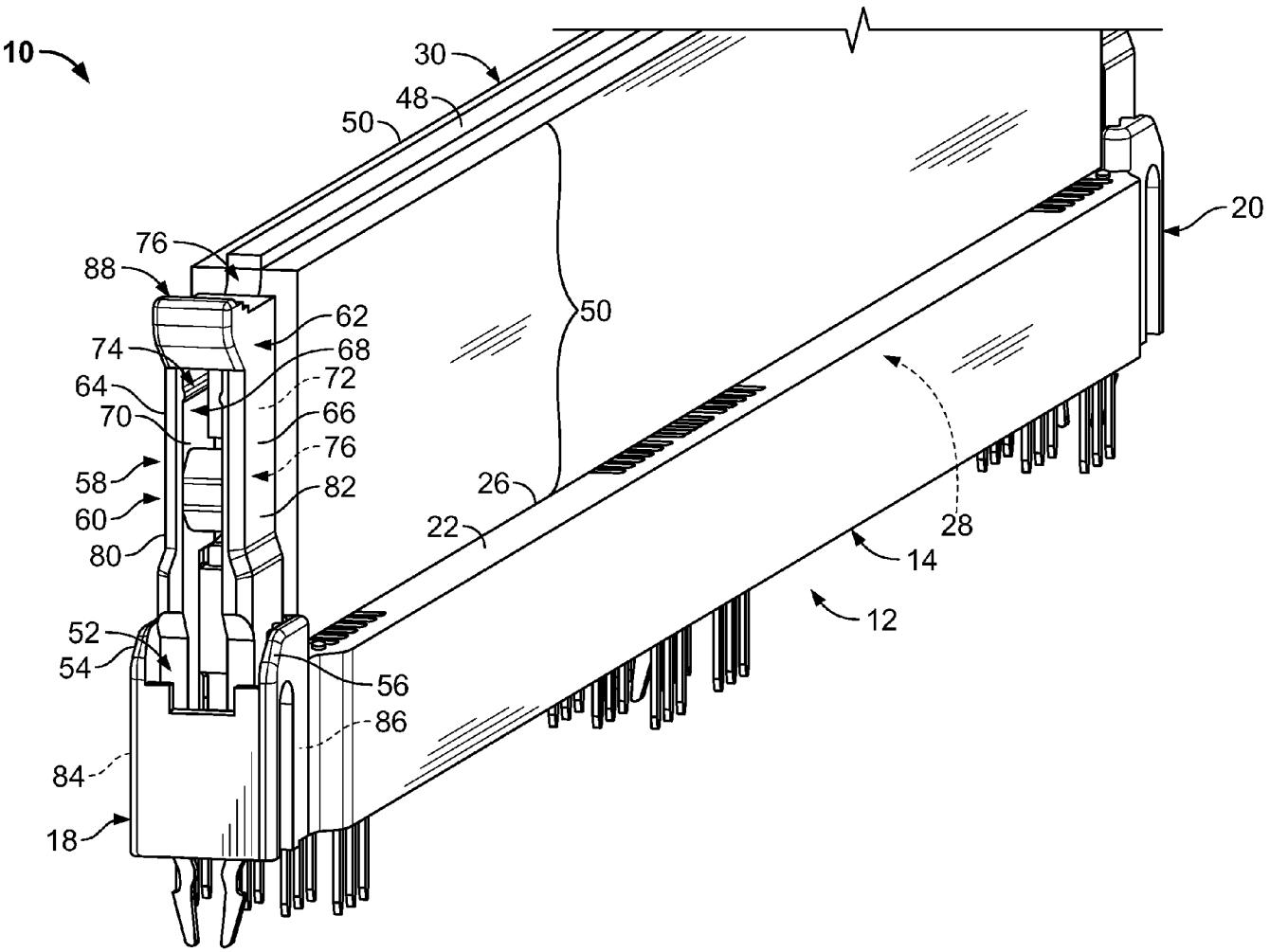
FIG. 2 is a partial perspective view of the socket connector assembly shown in FIG. 1 with an exemplary electronic module installed thereon.
Figure 7:
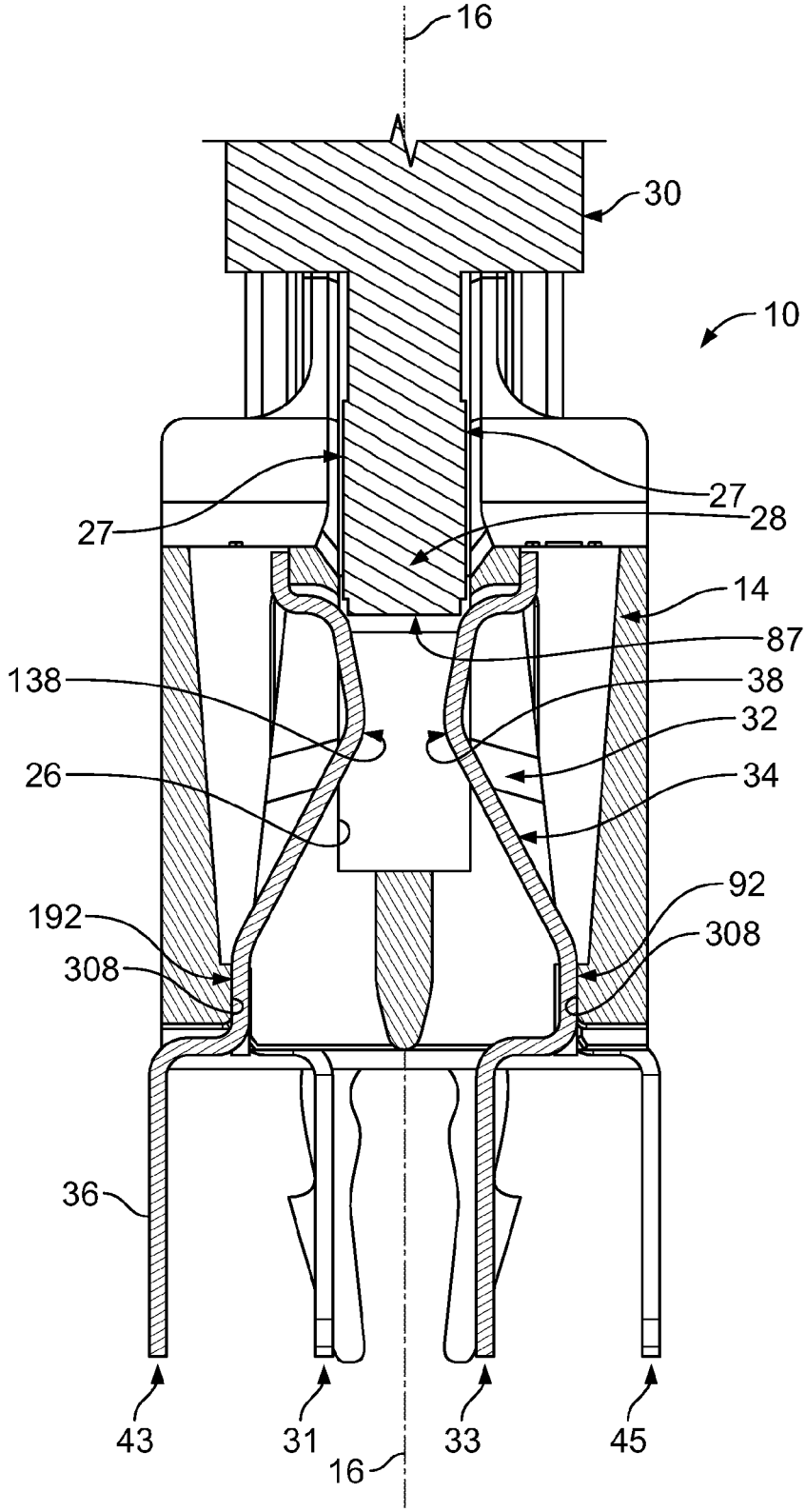
FIG. 7 is a cross-sectional view of the socket connector assembly shown in FIGS. 1 and 2 illustrating the electronic module partially received within an exemplary embodiment of a slot of the socket connector assembly.

FIG. 1 is a partially exploded perspective view of an exemplary embodiment of a socket connector assembly 10 and an exemplary circuit board 42. The socket connector assembly 10 includes a housing 12 having a dielectric body 14 that extends along a central longitudinal plane 16 between opposite end portions 18 and 20. The body 14 has a mating face 22 and a mounting face 24. The body 14 includes a slot 26 that is configured to receive a mating edge portion 28 (FIG. 2) of an electronic module 30 (FIGS. 2 and 7). The housing body 14 includes a plurality of openings 32 that each communicate with the slot 26 and extend through the housing body 14 from the mating face 22 to the mounting face 24. As will be described below, each opening 32 holds a portion of a corresponding inner or outer electrical contact 34 and 36, respectively, therein. Each inner and outer electrical contact 34 and 36, respectively, includes a respective mating contact portion 38 and 138 (FIGS. 3 and 7) and a respective mounting contact portion 40 and 140. The mating contact portions 38 and 138 extend into the slot 26 to electrically engage contact pads 27 (FIG. 7) on the electronic module 30 when the electronic module 30 is installed in the socket connector assembly 10. The mounting contact portions 40 and 140 extend from the mounting face 24 of the housing body 14 and are configured to electrically connect the socket connector assembly 10 to the circuit board 42 to enable the connection of the electronic module 30 to the circuit board 42. The inner and outer electrical contacts 34 and 36, respectively, are alternated within adjacent openings 32 to form inner rows 31 and 33 (FIG. 7) of the mounting contact portions 40 and outer rows 43 and 45 (FIG. 7) of the mounting contact portions 140. Specifically, the mounting contact portions 40 of the inner electrical contacts 34 are arranged in a pair of opposite inner rows 31 and 33 that are offset on opposite sides of the central longitudinal plane 16 of the housing body 14. Similarly, the mounting contact portions 140 of the outer electrical contacts 36 are arranged in a pair of opposite outer rows 43 and 45 that are offset on opposite sides of the central longitudinal plane 16 of the housing body 14 by a greater amount than the inner rows 31 and 33. (The offsets of the mounting contact portions 40 and 140 are best seen in FIG. 7).

Optionally, a key 44 is provided at an off-center position in the slot 26 for reception within a notch (not shown) in the electronic module 30 to assure that the electronic module 30 is properly aligned with respect to the connector assembly 10. One or more board locks 46 are optionally provided to mechanically attach the socket connector assembly 10 to the circuit board 42.

FIG. 2 is a perspective view of the socket connector assembly 10 with an exemplary electronic module 30 installed thereon. The electronic module 30 includes a planar substrate 48 that has the mating edge portion 28 and a plurality of electrical traces (not shown), each of which terminates at a corresponding one of the contact pads (FIG. 7) on the mating edge portion 28. When the electronic module 30 is installed on the housing body 14 as shown in FIG. 2, each of the contact pads 27 on the mating edge portion 28 of the electronic module 30 electrically engages the mating contact portion 38 or 138 (FIGS. 3 and 7) of a corresponding one of the electrical contacts 34 or 36. The substrate 48 includes exemplary surface mounted components generally represented at 50.

The housing end portions 18 and 20 are substantially identical and therefore only the housing end portion 18 is described in detail. The housing end portion 18 includes a cavity 52 between opposed towers 54 and 56 that extend outwardly at the mating face 22 of the housing body 14. An extractor 58 is received in the cavity 52. The extractor 58 is pivotably connected to the housing end portion 18 for retaining the electronic module 30 on the housing body 14 and for extracting the electronic module 30 from the housing body 14. Specifically, the extractor 58 extends outwardly between the towers 54 and 56 and is pivotable between an open position (FIG. 1) for receiving the electronic module 30 within the slot 26 and a closed position (FIG. 2) for retaining the electronic module 30.

The extractor 58 includes a pair of opposite side portions 60 and 62 that each engages the electronic module 30. Specifically, each of the side portions 60 and 62 includes a side wall 64 and 66, respectively. The side walls 64 and 66 are spaced apart from one another such that an extractor slot 68 is defined therebetween. The extractor slot 68 is in communication with the slot 26 in the housing body 14. The extractor slot 68 receives an edge portion 76 of the substrate 48 of the electronic module 30. Opposite interior surfaces 70 and 72 of the side walls 64 and 66, respectively, include ribs 74 that engage the edge portion 76 of the substrate 48 of the electronic module 30 to stabilize the electronic module 30. Optionally, a beveled forward edge (not shown) on the ribs 74 provides guidance for facilitating entry of the edge portion 76 of the electronic module 30 into the extractor slot 68. The extractor 58 may include a latch element (not shown) that engages a notch (not shown) in the edge portion 76 of the substrate 48 of the electronic module 30 to facilitate retaining the electronic module 30 on the housing body 14. Opposite outer surfaces 80 and 82 of the side walls 64 and 66, respectively, may include a projection (not shown) that communicates with a retention receptacle (not shown) on inner surfaces 84 and 86 of the towers 54 and 56, respectively, to facilitate holding the extractor 58 in the closed position. A foot (not shown) of the extractor 58 engages a lower edge 87 (FIG. 7) of the mating edge portion 28 of the electronic module 30 to lift the electronic module 30 upward when the extractor 58 is opened to assist in the extraction of the electronic module 30 from the housing body 14. The extractor 58 optionally includes a thumb pad 88 for moving the extractor 58 between the open and closed positions.

Figure 3:
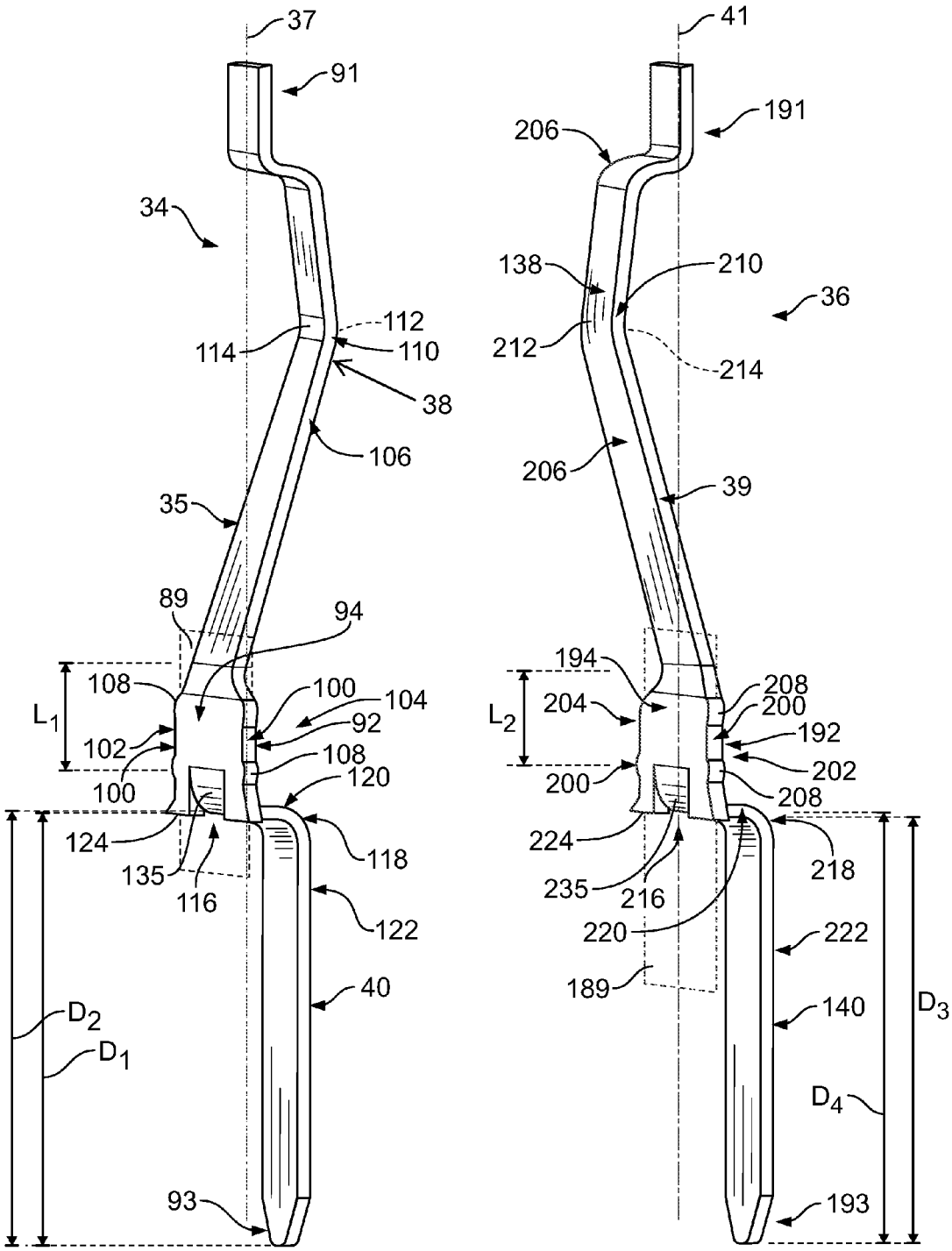
FIG. 3 is a perspective view of an exemplary embodiment of an inner electrical contact and an exemplary embodiment of an outer electrical contact of the socket connector assembly shown in FIGS. 1 and 2.

FIG. 3 is a perspective view of an exemplary embodiment of an inner electrical contact 34 and an exemplary embodiment of an outer electrical contact 36 of the socket connector assembly 10 (FIGS. 1, 2, and 7). Each inner electrical contact 34 includes a body 35 extending along a longitudinal axis 37. The body 35 includes the mating contact portion 38, the mounting contact portion 40, and an intermediate portion 92 extending between the mating contact portion 38 and the mounting contact portion 40. Similarly, each outer electrical contact 36 includes a body 39 extending along a longitudinal axis 41. The body 39 includes the mating contact portion 138, the mounting contact portion 140, and an intermediate portion 192 extending between the mating contact portion 138 and the mounting contact portion 140. In the exemplary embodiment, the mating contact portions 38 and 138 each include a respective end portion 91 and 191 of the respective inner and outer electrical contacts 34 and 36, and the mounting contact portions 40 and 140 each include a respective opposite end portion 93 and 193 of the inner and outer electrical contacts 34 and 36, respectively. The mating and mounting contact portions 38 and 40, respectively, of the inner electrical contact 34 are offset from a plane 89 of the intermediate portion 92 in generally the same direction. In contrast, the mating and mounting contact portions 138 and 140, respectively, of the outer electrical contact 36 are offset from a plane 189 of the intermediate portion 192 in generally opposite directions.

The intermediate portion 92 of the inner electrical contact 34 includes a stem 94 extending a length $L_1$. In the exemplary embodiment, a pair of extensions 100 extend outwardly at opposite side portions 102 and 104 of the stem 94. Similarly, the intermediate portion 192 of the outer electrical contact 36 includes a stem 194 extending a length $L_2$. A pair of extensions 200 extend outwardly at opposite side portions 202 and 204 of the stem 194. As will be described below, the extensions 100 and 200 are configured to engage the housing body 14 (FIGS. 1, 2, 6, and 7) to facilitate retaining the inner and outer electrical contacts 34 and 36, respectively, in position within the corresponding opening 32 (FIGS. 1, 6, and 7) of the housing body 14 using an interference-fit arrangement. Optionally, each of the extensions 100 and 200 includes one or more respective projections 108 and 208 that engage the housing body 14.

The mating contact portion 38 of the inner electrical contact 34 includes a stem 106 that extends from the stem 94 of the intermediate portion 92 to the end portion 91 of the inner electrical contact 34. The stem 106 includes a bend 110 having a radially outer surface 112 and a radially inner surface 114. The contact pads 27 (FIG. 7) of the electronic module 30 (FIGS. 2 and 7) engage the surface 112 of the stem 106 when the electronic module 30 is installed on the housing body 14. Similarly, the mating contact portion 138 of the outer electrical contact 36 includes a stem 206 that extends from the stem 194 of the intermediate portion 192 to the end portion 191 of the outer electrical contact 36. The stem 206 includes a bend 210 having a radially outer surface 212 and a radially inner surface 214. The contact pads 27 of the electronic module 30 engage the surface 212 of the stem 206 when the electronic module 30 is installed on the housing body 14.

The mounting contact portion 40 of the inner electrical contact 34 extends from the intermediate portion 92 at a bend 116. The mounting contact portion 40 extends from the bend 116 to the end portion 93 of the inner electrical contact 34. The mounting contact portion 40 includes an optional bend 118. Moreover, in the exemplary embodiment, the bends 116 and 118 are each approximately 90° such that sub-portions 120 and 122 of the mounting contact portion 40 extend approximately perpendicular and approximately parallel, respectively, to the longitudinal axis 37. Alternatively, the bend 116 and/or 118 may have any other angle than approximately 90° such that the sub-portions 120 and 122 each extend at any other angle relative to the longitudinal axis 37. The end portion 93 may be referred to herein as the end portion of a mounting contact portion. The bends 116 and 118 may be referred to herein as a "first bend" and a "second bend" respectively.

Similar to the inner electrical contact 34, the mounting contact portion 140 of the outer electrical contact 36 extends from the intermediate portion 192 at a bend 216. The mounting contact portion 140 extends from the bend 216 to the end portion 193 of the outer electrical contact 36. The mounting contact portion 140 includes an optional bend 218. Moreover, in the exemplary embodiment, the bends 216 and 218 are each approximately 90° such that sub-portions 220 and 222 of the mounting contact portion 140 extend approximately perpendicular and approximately parallel, respectively, to the longitudinal axis 41. Alternatively, the bend 216 and/or 218 may have any other angle than approximately 90° such that the sub-portions 220 and 222 each extend at any other angle relative to the longitudinal axis 41. The end portion 193 may be referred to herein as the end portion of a mounting contact portion. The bends 216 and 218 may be referred to herein as a "first bend" and a "second bend" respectively.

Figure 4:
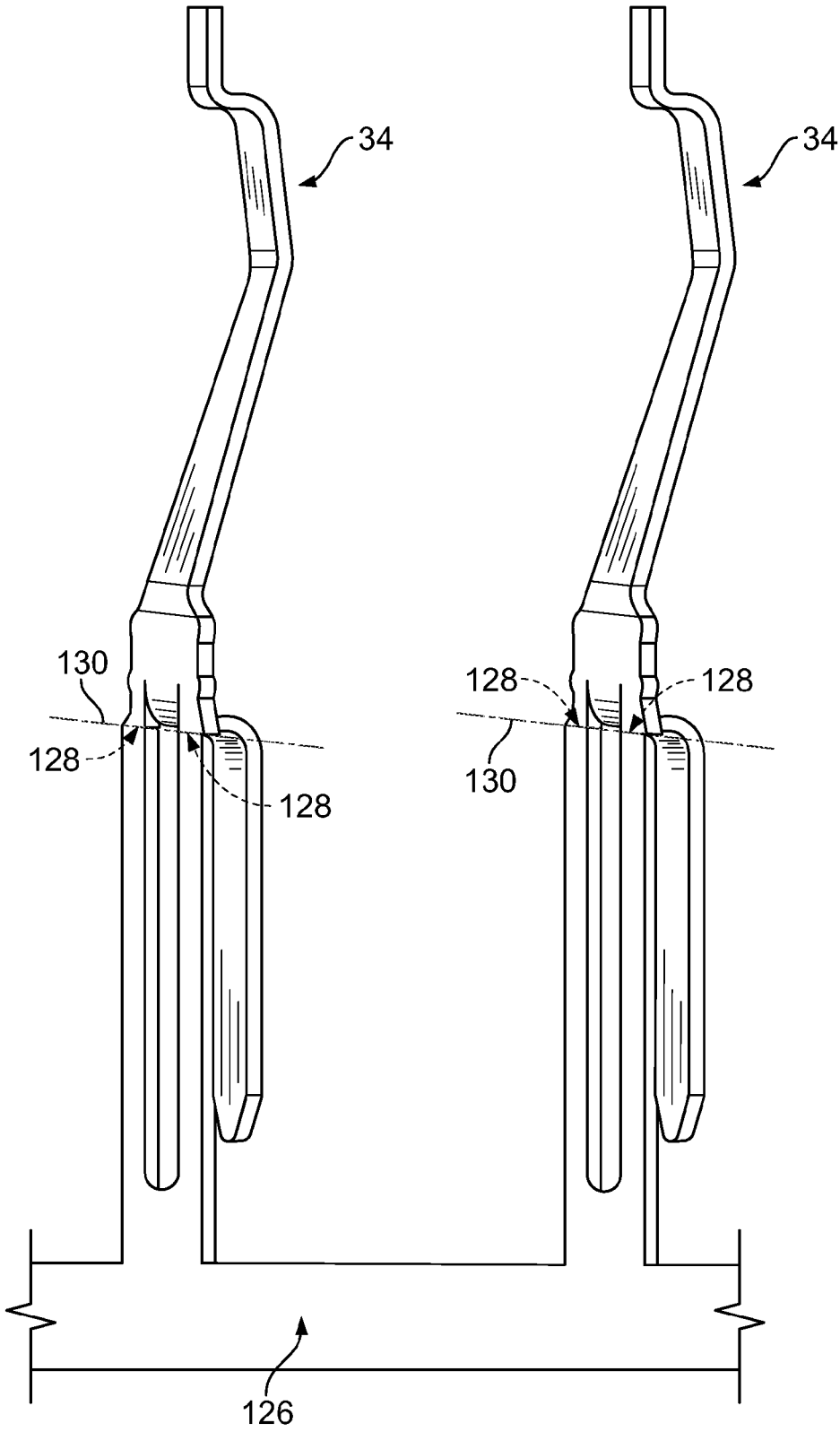
FIG. 4 is a perspective view of a plurality of the inner electrical contacts shown in FIG. 3 illustrating a portion of an exemplary carrier strip connected thereto.

Each of the inner and outer electrical contacts 34 and 36, respectively, includes one or more respective push surfaces 124 and 224. The push surfaces 124 are formed when a carrier strip 126 (FIG. 4) is separated from the inner electrical contact 34. Similarly, the push surfaces 224 are formed when a carrier strip (not shown) is separated from the outer electrical contact 36. FIG. 4 is a perspective view of a plurality of the inner electrical contacts 34 illustrating a portion of an exemplary carrier strip 126 connected thereto. In the exemplary embodiment, the carrier strip 126 initially connects together a plurality of the inner electrical contacts 34 that are fabricated together. The inner electrical contacts 34 may be fabricated together using any process, method, structure, means, configuration, arrangement, and/or the like, such as, but not limited to, being stamped and/or formed from a sheet of material. After at least some portion of each of the electrical contacts 34 has been fabricated, the carrier strip 126 is separated from the inner electrical contacts 34 at one or more separation points 128 along a separation axis 130. Once the carrier strip 126 has been separated from the inner electrical contacts 34 at the separation points 128, the surface(s) remaining on the inner electrical contacts 34 at the separation point 128 defines the push surface(s) 124 (FIGS. 3 and 5) of each inner electrical contact 34. Although shown as still connected to the carrier strip 126 after the finished geometry and/or shape of each of the inner electrical contacts 34 has been formed (excepting the push surface(s) 124), each inner electrical contact 34 may be separated from the carrier strip 126 when only some of the finished geometry and/or shape of the inner electrical contact 34 has been formed.

Although not shown, a plurality of the outer electrical contacts 36 (FIGS. 1, 3, 5, and 7) may be initially connected together by a carrier strip (not shown) during and/or after fabricated thereof. Connection of a plurality of the outer electrical contacts 36 together by a carrier strip, as well as separation therefrom, is similar to that shown and described herein for the inner electrical contacts 34 and therefore will not be shown or described in more detail herein. Moreover, although not shown herein, one or more of the inner electrical contacts 34 may be initially connected with one or more of the outer electrical contacts 36 when one or more of the inner electrical contacts 34 is fabricated together with one or more of the outer electrical contacts 36.

Figure 5:
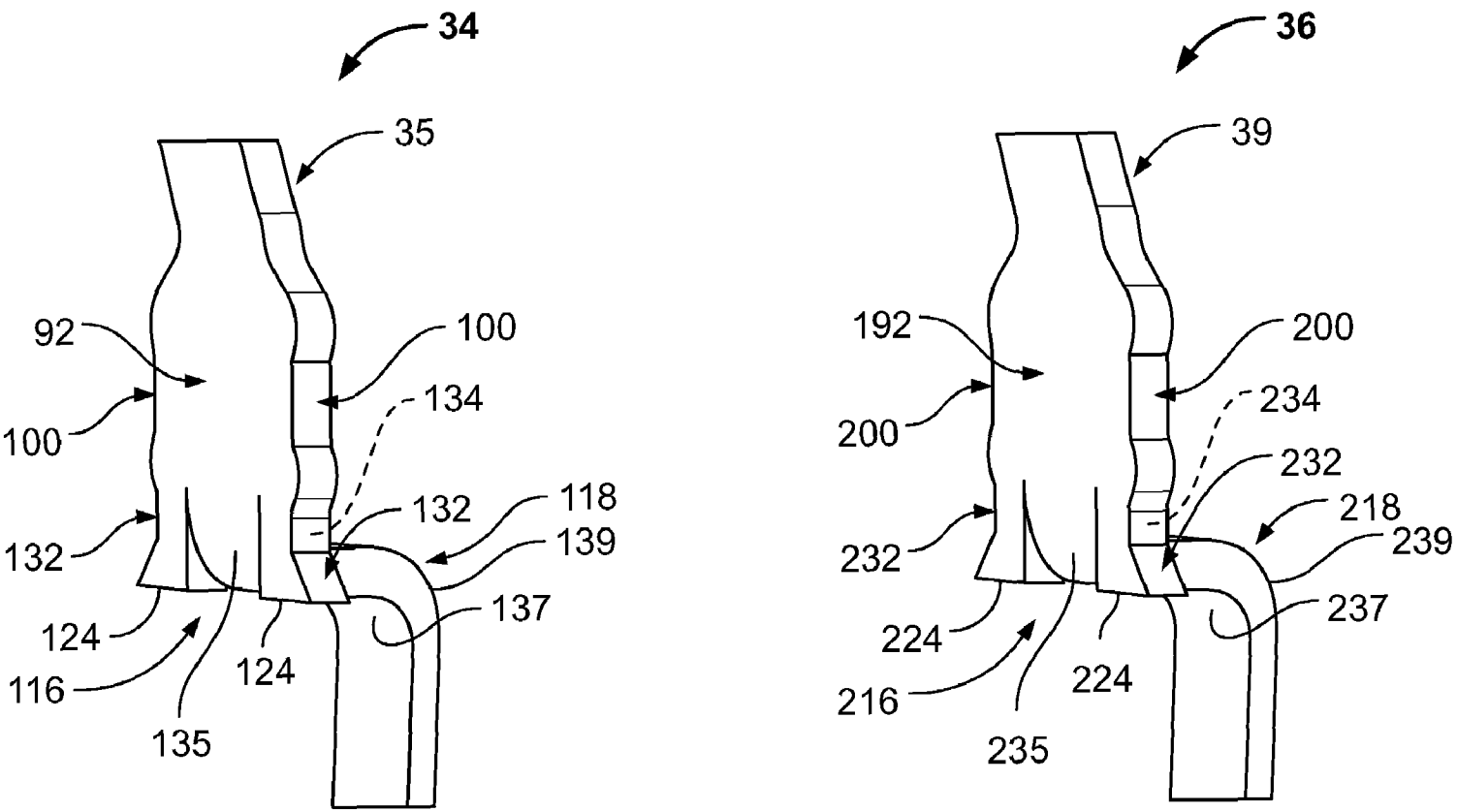
FIG. 5 is an enlarged perspective view of a portion of each of the inner and outer electrical contacts shown in FIG. 3.

FIG. 5 is an enlarged perspective view of a portion of each of the inner and outer electrical contacts 34 and 36 illustrating the push surfaces 124 and 224. In the exemplary embodiment, the bodies 35 and 39 of the inner and outer electrical contacts 34 and 36, respectively, each include a respective pair of arms 132 and 232. Each of the arms 132 and 232 extends from the respective intermediate portion 92 and 192. An end portion of each of the arms 132 and 232 includes the respective push surface 124 and 224. Each of the arms 132 and 232 optionally extends from a corresponding one of the respective extensions 100 and 200 such that the push surfaces 124 and 224 are defined by the respective extensions 100 and 200. In the exemplary embodiment, the bends 116 and 216 extend between the respective pair of arms 132 and 232. As can be most clearly seen in FIG. 5, the bends 116 and 216 each include a respective radially inner surface 134 and 234 and a respective radially outer surface 135 and 235. Similarly, the bends 118 and 218 each include a respective radially inner surface 137 and 237 and a respective radially outer surface 139 and 239.

Although each electrical contact 34 and 36 is shown as having a respective pair of two arms 132 and 232 and a respective pair of two push surfaces 124 and 224, each electrical contact 34 and 36 may include any number of arms 132 and 232, respectively, and each electrical contact 34 and 36 may include any number of push surfaces 124 and 224, respectively.

Referring again to FIG. 3, in the exemplary embodiment each of the push surfaces 124 and 224 is located closer along the respective longitudinal axis 37 and 41 to the respective end portion 93 and 193 than the respective bend 116 and 216. Specifically, each of the push surfaces 124 is located a distance $D_1$ from the end portion 93 that is less than a distance $D_2$ of the closest portion of the radially outer surface 135 of the bend 116 to the end portion 93. Similarly, each of the push surfaces 224 is located a distance $D_3$ from the end portion 193 that is less than a distance $D_4$ of the closest portion of the radially outer surface 235 of the bend 216 to the end portion 193. In other words, in the exemplary embodiment, each of the push surfaces 124 and 224 is offset from the respective bend 116 and 216 along the respective longitudinal axis 37 and 41 in a direction away from the respective mating contact portion 38 and 138. Alternatively one or more of the push surfaces 124 and/or 224 is located a distance from the respective end portion 93 and 193 that is approximately equal to a distance of any portion of the respective bend 116 and 216 from the respective end portion 93 and 193. The distance $D_1$ of each of the push surfaces 124 from the end portion 93 is optionally less than, or approximately equal to, a distance of any portion (e.g., the radially inner surface 137) of the bend 118 from the end portion 93. Similarly, the distance $D_3$ of each of the push surfaces 224 from the end portion 193 is optionally less than, or approximately equal to, a distance of any portion (e.g., the radially inner surface 237) of the bend 218 from the end portion 193.

Although one pair of two of each of the extensions 100 and the extensions 200 are shown, the respective intermediate portions 92 and 192 may each include any number of pairs of the respective extensions 100 and 200, and any number of the respective extensions 100 and 200 overall, that enable the extension(s) 100 and 200 to function as described and/or illustrated herein. In some embodiments, some or all of the extensions 100 and/or 200 are not paired with another respective extension 100 and 200 on the opposite side portion 102 or 104 and 202 or 204, respectively. Moreover, each extension 100 and 200 may extend from either of the side portion 102 or 104 and 202 or 204, respectively, and may be located at any portion of the respective length $L_1$ and $L_2$ of the respective stem 94 and 194 (whether or not the extension 100 and/or 200 is paired with, and/or has the same location along the respective length $L_1$ and $L_2$ as, another extension 100 and 200, respectively, on the respective opposite side portion 102 or 104 and 202 or 204).

The size, shape, and location on the electrical contacts 34 and 36 of each of the respective portions 38, 40, 92, 138, 140, and 192, as well as the overall size and geometry of the electrical contacts 34 and 36 overall, is not limited to the embodiments described and illustrated herein, but rather may be any size, shape, location, geometry, and/or the like that enables the electrical contacts 34 and 36 to function as described and/or illustrated herein. In the some embodiments, the exemplary geometry of the electrical contacts 34 and 36 described and/or illustrated herein may result in approximately equal electrical path lengths between some or all of the mounting contact portions 40 and/or 140.

Figure 6:
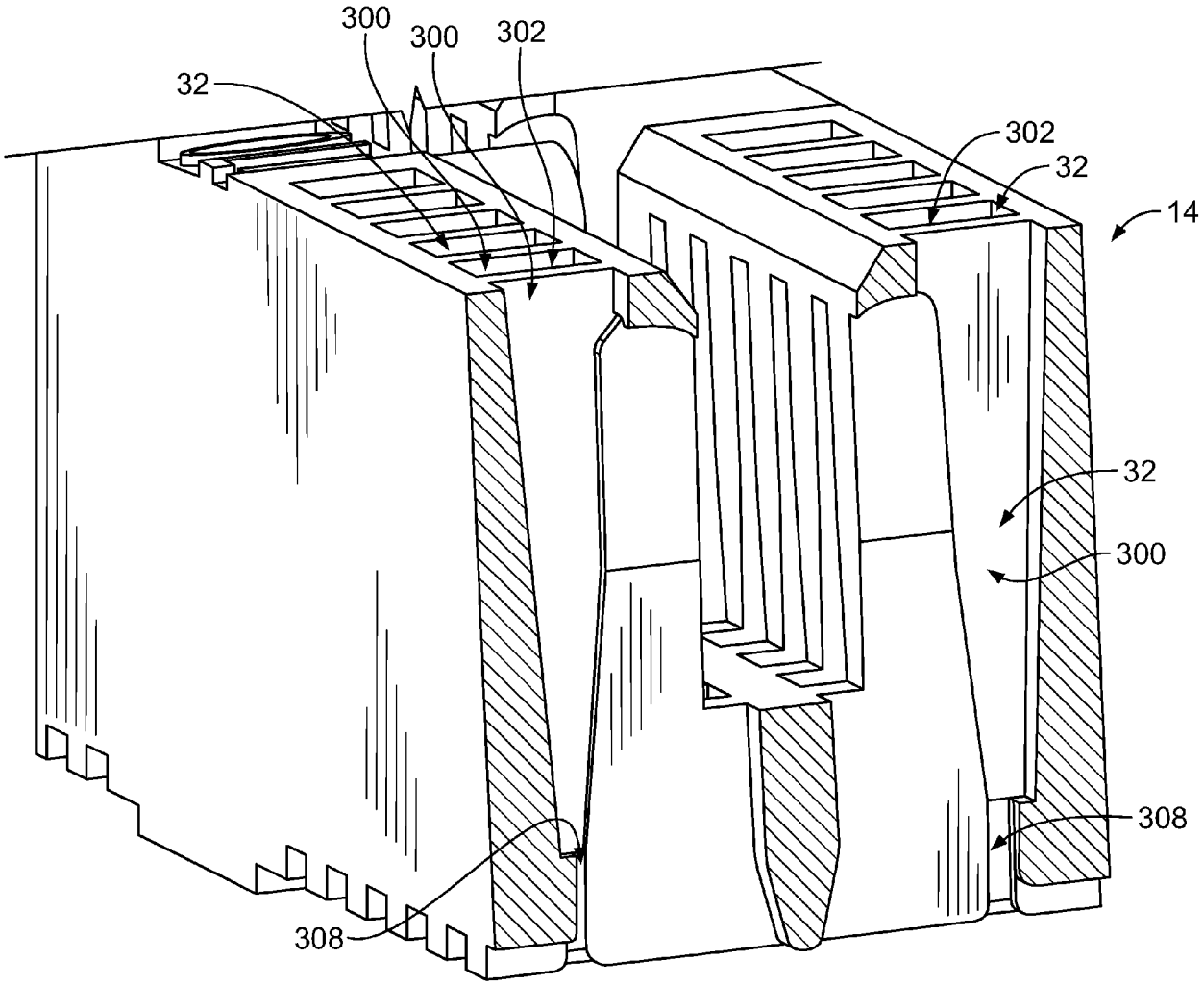
FIG. 6 is a perspective view illustrating a cross section of an exemplary embodiment of a housing of the socket connector assembly shown in FIGS. 1 and 2 taken along line 6-6 of FIG. 1.

FIG. 6 is a perspective view illustrating a cross section of the housing body 14 of the socket connector assembly 10 (FIGS. 1, 2, and 7) taken along line 6-6 of FIG. 1. The housing body 14 is illustrated in FIG. 6 with the inner and outer electrical contacts 34 and 36 (FIGS. 1, 3, 5, and 7), respectively, removed therefrom. Each of the openings 32 within the housing body 14 includes a pair of opposite side walls 300 and 302. Each opening 32 includes a portion 308 that is configured to receive a corresponding one of the intermediate portions 92 or 192 (FIG. 3). A corresponding one of the pair of extensions 100 or 200 (FIGS. 3 and 5) engages the side walls 300 and 302 to facilitate retaining the corresponding electrical contact 34 or 36 in position within the opening 32 using an interference-fit arrangement. Optionally, the projections 108 or 208 (FIGS. 3 and 5) of the corresponding extension 100 or 200 engage the side walls 300 and 302 to facilitate retaining the corresponding electrical contact 34 or 36 using an interference-fit arrangement.

Although the exemplary embodiment includes two, each side wall 300 and 302 of each opening 32 may include any number of portions 308 for cooperating with any number of extensions 100 or 200 on the corresponding intermediate portion 92 or 192. Each portion 308 may include any suitable shape, and may have any suitable location on the corresponding side wall 300 or 302, that enables the portion 308 to cooperate with the corresponding extension 100 or 200 to facilitate retaining the corresponding electrical contact 34 or 36 as described and illustrated herein.

FIG. 7 is a cross-sectional view of the socket connector assembly 10 illustrating the electronic module 30 partially received within the slot 26. The housing body 14 is illustrated in FIG. 7 with the inner and outer electrical contacts 34 and 36, respectively, positioned within the corresponding openings 32. As the electronic module 30 is inserted within the slot 26, the contact pads 27 of the electronic module 30 engage the mating portions 38 and 138 to electrically connect the electrical contacts 34 and 36 with the electronic module 30. When the electrical contacts 34 and 36 are received within the corresponding openings 32, the intermediate portions 92 and 192 are received within the corresponding portion 308 and the extensions 100 or 200 (FIGS. 3 and 5) engage the side walls 300 and 302 to facilitate retaining the electrical contact 34 or 36 in position within the opening 32 using an interference-fit arrangement. Optionally, the projections 108 and 208 (FIG. 3) of the extensions 100 and 200 engage the side walls 300 and 302 to facilitate retaining the corresponding electrical contact 34 or 36 using an interference-fit arrangement.

In the exemplary embodiment of FIGS. 1-7, the mounting contact portions 40 and 140 of the electrical contacts 34 and 36, respectively, are configured as solder tails that electrically connect to the circuit board 42 using solder. However, the mounting contact portions 40 and 140 are not limited to being solder tails, but rather may have any suitable arrangement, configuration, structure, geometry, and/or the like that enables the mounting contact portions 40 and 140 to electrically connected to the circuit board 42 and/or another electrical component, such as, but not limited to, using a press-fit arrangement, a surface mount arrangement, and/or the like.

Figure 8:
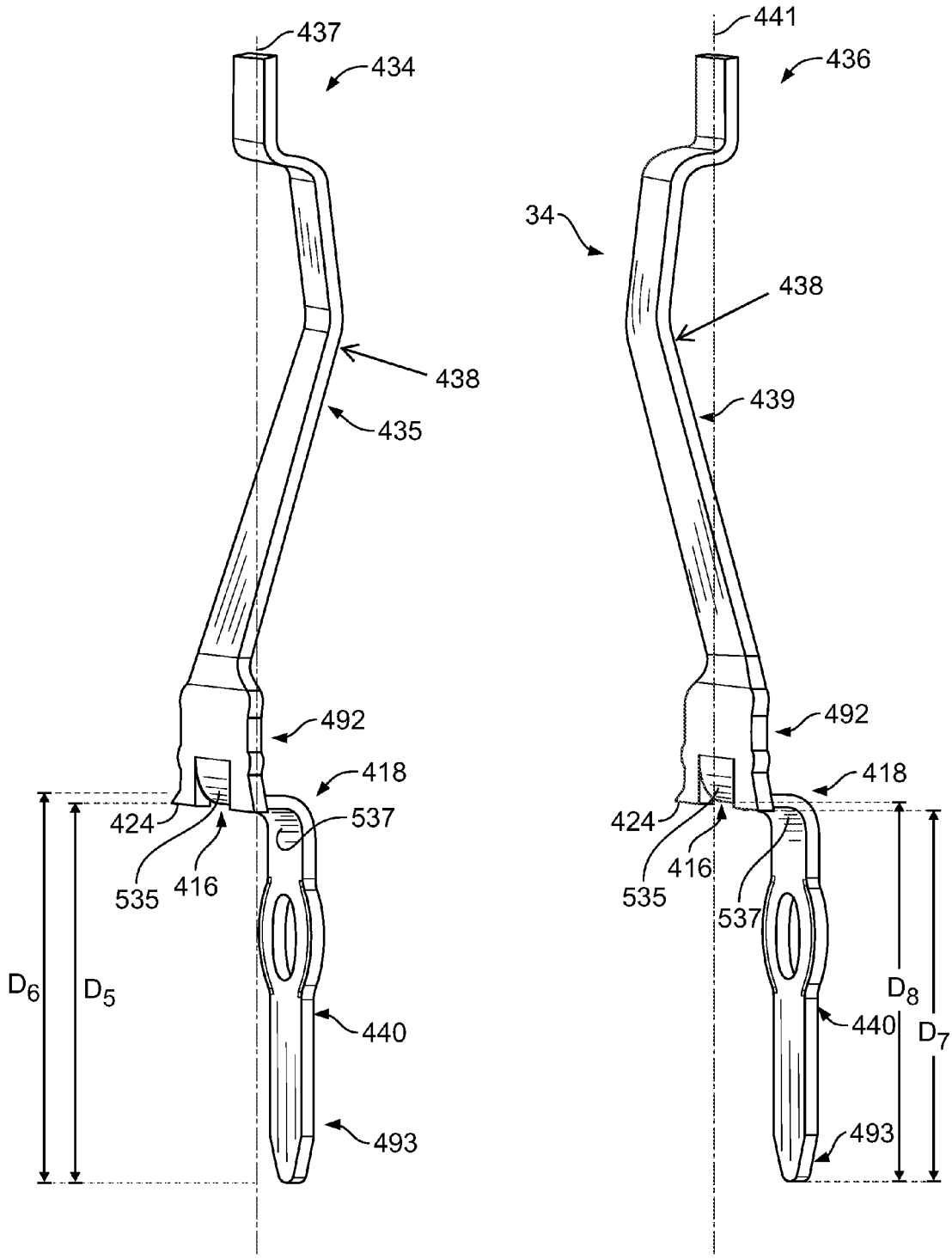
FIG. 8 is a perspective view of exemplary alternative embodiments of inner and outer electrical contacts.

For example, FIG. 8 is a perspective view of an exemplary alternative embodiment of inner and outer electrical contacts 434 and 436, respectively. Each of the electrical contacts 434 and 436 includes a respective body 435 and 439 extending along a respective longitudinal axis 437 and 441. The bodies 435 and 439 each include mating contact portions 438, mounting contact portions 440, and intermediate portions 492 extending between the mating contact portions 438 and the mounting contact portions 440. The mounting contact portions 440 each extend from the corresponding intermediate portion 492 at a bend 416. In the exemplary embodiment, the mounting contact portions 440 each include an end portion 493 of the corresponding electrical contact 434 or 436. As can be seen in FIG. 8, each of the mounting contact portions 440 is configured to electrically connect to a circuit board or other electrical component using a press-fit arrangement.

Each of the electrical contacts 434 and 436 includes one or more push surfaces 424. In the exemplary embodiment, each of the push surfaces 424 is located closer along the corresponding longitudinal axis 437 and 441 to the corresponding end portion 493 than the corresponding bend 416. Specifically, with respect to the inner electrical contact 434, each of the push surfaces 424 is located a distance $D_5$ from the end portion 493 that is less than a distance $D_6$ of the closest portion of a radially outer surface 535 of the bend 416 to the end portion 493. Similarly, with respect to the outer electrical contact 436, each of the push surfaces 424 is located a distance $D_7$ from the end portion 493 that is less than a distance $D_8$ of the closest portion of a radially outer surface 535 of the bend 416 to the end portion 493. In other words, in the exemplary embodiment, each of the push surfaces 424 is offset from the corresponding bend 416 along the corresponding longitudinal axis 437 and 441 in a direction away from the corresponding mating contact portion 438. Alternatively one or more of the push surfaces 424 is located a distance from the corresponding end portion 493 that is approximately equal to a distance of any portion of the corresponding bend 416 from the corresponding end portion 493. The distances $D_5$ and $D_7$ of each of the corresponding push surfaces 424 from the corresponding end portion 493 is optionally less than, or approximately equal to, a distance of any portion (e.g., a radially inner surface 537) of an optional corresponding bend 418 from the corresponding end portion 493.

Figure 9:
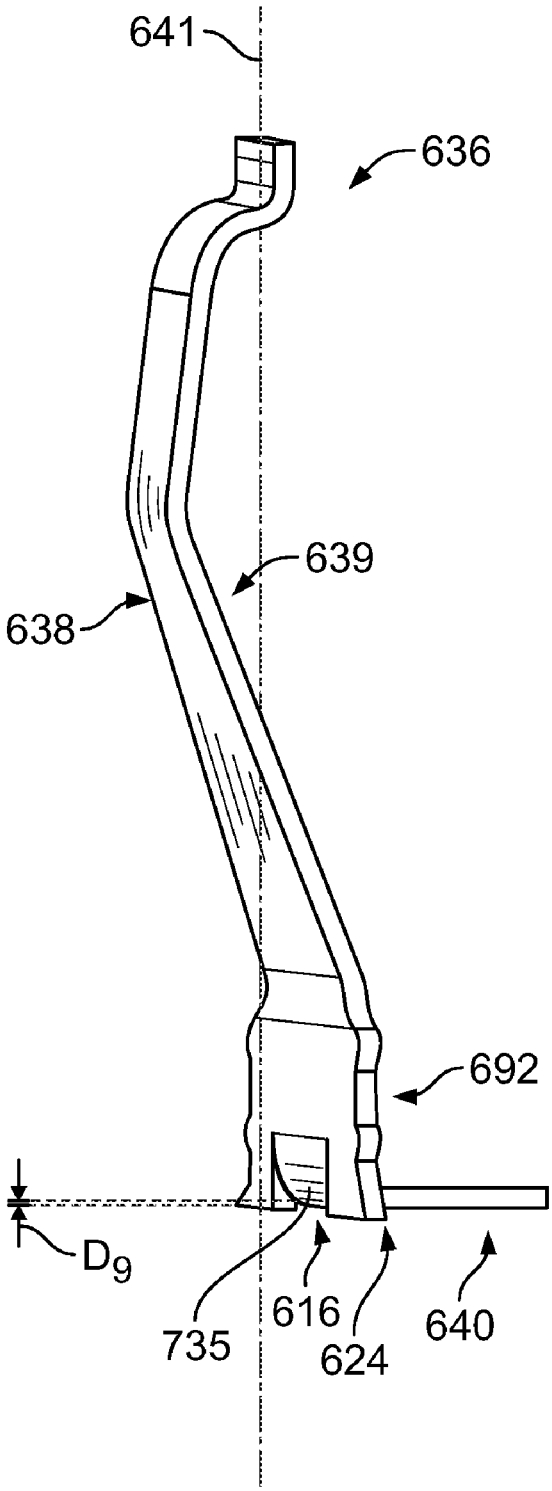
FIG. 9 is a perspective view of another exemplary alternative embodiment of an outer electrical contact.

Moreover, and for example, FIG. 9 is a perspective view of an exemplary alternative embodiment of an outer electrical contact. The electrical contact 636 includes a body 639 extending along a longitudinal axis 641. The body 639 includes a mating contact portion 638, a mounting contact portion 640, and an intermediate portion 692 extending between the mating contact portion 638 and the mounting contact portion 640. The mounting contact portion 640 extends from the intermediate portion 692 at a bend 616. As can be seen in FIG. 9, the mounting contact portion 640 is configured to electrically connect to a circuit board or other electrical component using a surface mount arrangement.

The electrical contact 636 includes one or more push surfaces 624. In the exemplary embodiment, each of the push surfaces 624 is offset from the bend 616 along the longitudinal axis 641 in a direction away from the mating contact portion 638. Specifically, each of the push surfaces 624 is offset along the longitudinal axis 641 a distance $D_9$ from a portion of a radially outer surface 735 of the bend 616 that is furthest (along the longitudinal axis 641) from the mating contact portion 638. Alternatively one or more of the push surfaces 624 is approximately aligned with any portion of the bend 616.

The embodiments described and/or illustrated herein may provide a lower profile socket connector that may be suitable for use in limited space applications. For example, the embodiments described and/or illustrated herein provide a socket connector having electrical contacts that may have a mating contact portion having an increased length. In some embodiments, the connector meets ATCA height restrictions. The embodiments described and/or illustrated herein may provide an electrical connector wherein some or all of a plurality of electrical contacts of the electrical connector have a skewless electrical path.

The connector embodiments described and/or illustrated are not limited to use with any exemplary type of electronic module described and/or illustrated herein, but rather may be used with any suitable type of electronic module, such as, but not limited to, processor modules and/or memory modules, such as, but not limited to, Dynamic Random Access Memory (DRAM), Synchronous Dynamic Random Access Memory (SDRAM), Extended Data Out Random Access Memory (EDO RAM), Single In-line Memory Modules (SIMM's), Dual In-line Memory Modules (DIMM's), Small Outline DIMM's (SODIMM's), Fully Buffered DIMM's, and/or the like. Although described and illustrated herein as a socket connector, the embodiments described and/or illustrated herein are not limited to socket connectors, but rather may be any suitable type of connector, such as, but not limited to, a plug connector and/or a surface connector.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. An electrical contact comprising: a body extending along a longitudinal axis, said body comprising:

a mating contact portion for electrical connection with an electronic module;

an intermediate portion extending from the mating contact portion;

a mounting contact portion extending from the intermediate portion for electrical connection with a circuit board, the mounting contact portion extending from the intermediate portion at a first bend, the mounting contact portion extending from the first bend to an end portion, the mounting contact portion further comprising a second bend; and a push surface formed when a carrier strip that initially connects the electrical contact to other electrical contacts is separated from the electrical contact, wherein the push surface is offset from the second bend along the longitudinal axis in a direction away from the mating contact portion.

2. An electrical contact comprising:

a body extending along a longitudinal axis, said body comprising:

a mating contact portion for electrical connection with an electronic module;

an intermediate portion extending from the mating contact portion;

a mounting contact portion extending from the intermediate portion for electrical connection with a circuit board, the mounting contact portion extending from the intermediate portion at a bend, the mounting contact portion extending from the bend to an end portion, wherein the bend extends from an intermediate end to a mounting end, the intermediate end extending from the intermediate portion, the mounting contact portion extending from the mounting end of the bend; and a push surface formed when a carrier strip that initially connects the electrical contact to other electrical contacts is separated from the electrical contact, the push surface being offset from the mounting end of the bend along the longitudinal axis in a direction away from the mating contact portion.

3. The electrical contact according to claim 1, wherein the body further comprises an arm extending from the intermediate portion, the arm having an end portion that comprises the push surface.

4. The electrical contact according to claim 1, wherein the first bend comprises a radially inner surface and a radially outer surface, the push surface being offset from the radially outer surface of the first bend along the longitudinal axis in a direction away from the mating contact portion.

5. The electrical contact according to claim 1, wherein the push surface is offset from an approximate entirety of the first bend along the longitudinal axis in a direction away from the mating contact portion.

6. The electrical contact according to claim 1, wherein the body further comprises a pair of arms extending from the intermediate portion, the push surface comprising a pair of push surfaces, each arm having an end portion that comprises a corresponding one of the push surfaces, wherein the first bend extends between the pair of arms.

7. The electrical contact according to claim 1, wherein the intermediate portion comprises an extension configured to engage a housing for retaining the electrical contact within the housing, wherein the push surface is defined by a portion of the extension.

8. The electrical contact according to claim 1, wherein the push surface is approximately planar.

9. A socket connector assembly for connecting an electronic module to a circuit board, said socket connector comprising:

a housing having a slot configured to receive a mating edge of the electronic module; and a plurality of electrical contacts held by the housing, each electrical contact comprising a body extending along a longitudinal axis, said body comprising:

a mating contact portion for electrical connection to the electronic module;

an intermediate portion extending from the mating contact portion;

a mounting contact portion extending from the intermediate portion for electrical connection with the circuit board, the mounting contact portion extending from the intermediate portion at a bend, the mounting contact portion extending from the bend to an end portion; and a push surface formed when a carrier strip that initially connects the electrical contact to other electrical contacts is separated from the electrical contact, wherein the push surface is offset from an approximate entirety of the bend along the longitudinal axis in a direction away from the mating contact portion.

10. The socket connector assembly according to claim 9, wherein the bend extends from an intermediate end to a mounting end, the intermediate end extending from the intermediate portion, the mounting contact portion extending from the mounting end of the bend, the push surface being offset from the mounting end of the bend in a direction away from the mating contact portion.

11. The socket connector assembly according to claim 9, wherein the body further comprises an arm extending from the intermediate portion, the arm having an end portion that comprises the push surface.

12. The socket connector assembly according to claim 9, wherein the bend comprises a radially inner surface and a radially outer surface, the push surface being offset from the radially outer surface of the bend along the longitudinal axis in a direction away from the mating contact portion.

13. The socket connector assembly according to claim 9, wherein the body further comprises a pair of arms extending from the intermediate portion, the push surface comprising a pair of push surfaces, each arm having an end portion that comprises a corresponding one of the push surfaces, wherein the bend extends between the pair of arms.

14. The socket connector assembly according to claim 9, wherein the bend is a first bend, the mounting contact portion further comprising a second bend.

15. The socket connector assembly according to claim 9, wherein the bend is a first bend, the mounting contact portion further comprising a second bend, wherein the push surface is offset from the second bend along the longitudinal axis in a direction away from the mating contact portion.

16. The socket connector assembly according to claim 9, wherein the intermediate portion comprises an extension configured to engage a housing for retaining the corresponding electrical contact within the housing, wherein the push surface is defined by a portion of the extension.

17. The socket connector assembly according to claim 9, wherein the push surface is approximately planar.

* * * * *